US011117339B2

(12) United States Patent
Li

(10) Patent No.: US 11,117,339 B2
(45) Date of Patent: Sep. 14, 2021

(54) COMPRESSOR FOR CARBONATED BEVERAGE CONTAINERS

(71) Applicant: Ai Li, Boulder, CO (US)

(72) Inventor: Ai Li, Boulder, CO (US)

(73) Assignee: Ai Li, Boulder, CO (US)

( * ) Notice: Subject to any disclaimer, the term of this patent is extended or adjusted under 35 U.S.C. 154(b) by 932 days.

(21) Appl. No.: 14/097,112

(22) Filed: Dec. 4, 2013

(65) Prior Publication Data

US 2015/0151907 A1 Jun. 4, 2015

(51) Int. Cl.

| | |
|---|---|
| ***B30B 9/00*** | (2006.01) |
| ***B65D 90/38*** | (2006.01) |
| ***B30B 9/32*** | (2006.01) |
| ***B30B 7/04*** | (2006.01) |
| ***B65D 1/32*** | (2006.01) |
| ***B30B 1/20*** | (2006.01) |
| ***B30B 1/18*** | (2006.01) |
| ***B02C 19/00*** | (2006.01) |

(52) U.S. Cl.

CPC ..... *B30B 9/00* (2013.01); *B02C 19/0093* (2013.01); *B30B 1/181* (2013.01); *B30B 1/20* (2013.01); *B30B 7/04* (2013.01); *B30B 9/321* (2013.01); *B30B 9/322* (2013.01); *B65D 1/32* (2013.01); *B65D 90/38* (2013.01); *Y10S 100/902* (2013.01)

(58) Field of Classification Search

CPC ..... B65D 41/083; B65D 41/086; B65D 1/32; F16L 3/1025; F16L 3/105; F16L 3/1066; F16L 3/1075; B30B 9/121; B30B 9/12; B30B 9/045; B30B 9/00; B30B 9/166; B30B 9/16; B30B 9/14; B30B 9/3032; B30B 9/3082; B30B 9/321; B30B 9/322; B30B 9/323; B30B 7/04; B30B 1/181; B30B 1/20; A44B 11/12; A61B 5/6838; F16B 7/00; F16B 7/04; Y10S 100/902; B02C 19/0093

See application file for complete search history.

(56) References Cited

U.S. PATENT DOCUMENTS

| | | | |
|---|---|---|---|
| 2,534,708 | A | 12/1950 | Goodheart |
| 2,587,191 | A | 2/1952 | Merullo |

(Continued)

FOREIGN PATENT DOCUMENTS

| | | |
|---|---|---|
| GB | 2178001 | 2/1987 |
| KR | 10-2010-0081895 | 7/2010 |

OTHER PUBLICATIONS

Actuator—Marriam-Webster Definition Mar. 3, 2019 (Year: 2019).*

*Primary Examiner* — Jimmy T Nguyen

(74) *Attorney, Agent, or Firm* — Davis, Graham & Stubbs LLP

(57) ABSTRACT

A compression device allows for compressing a carbonated beverage container, for maintaining the container in a compressed state, and for releasing the container from the compressed state when desired. In one embodiment, the compression device (100) includes a first frame (101), a second frame (102), a first linking frame (103) and a second linking frame (104). The frames are joined together by hinge connectors (111, 112, 113, and 114), forming a quadrilateral enclosure or compression assembly that accepts a PET bottle. A hinge controller (119), associated with the first hinge connector (111), is operative to control compression and release of the bottle.

37 Claims, 8 Drawing Sheets

(56) References Cited

U.S. PATENT DOCUMENTS

| | | | | | |
|---|---|---|---|---|---|
| 2,689,141 | A * | 9/1954 | Kiekhaefer | F16L 23/06 | 24/279 |
| 2,775,806 | A * | 1/1957 | Love | F16L 23/06 | 24/271 |
| 3,901,141 | A * | 8/1975 | Bochmann | B30B 9/321 | 100/236 |
| 4,341,406 | A * | 7/1982 | Abbes | F16L 23/10 | 24/279 |
| 4,747,496 | A | 5/1988 | Rendine | | |
| 4,989,743 | A | 2/1991 | Lowery | | |
| 5,025,953 | A | 6/1991 | Doundoulakis | | |
| 5,233,917 | A * | 8/1993 | Handzlik | B02C 19/0093 | 100/232 |
| 5,681,135 | A * | 10/1997 | Simonson | F16B 23/0084 | 411/14 |
| 5,765,708 | A | 6/1998 | Fragos | | |
| 5,802,968 | A | 9/1998 | Kirschner et al. | | |
| 6,050,181 | A * | 4/2000 | Zenk | B30B 9/321 | 100/215 |
| 7,290,486 | B2 | 11/2007 | Lafond | | |
| D639,118 | S | 6/2011 | Huang | | |
| 8,074,567 | B2 | 12/2011 | Atiyeh et al. | | |
| 8,919,456 | B2 * | 12/2014 | Ng | G05B 15/02 | 173/11 |
| 9,086,177 | B2 * | 7/2015 | Artsiely | F16L 21/06 | |
| 2010/0155361 | A1 * | 6/2010 | Atiyeh | B30B 9/321 | 215/390 |
| 2010/0314870 | A1 * | 12/2010 | Cromarty | F16L 25/0018 | 285/420 |
| 2016/0186902 | A1 * | 6/2016 | Lee | F16L 21/06 | 285/420 |

* cited by examiner

COMPRESSOR FOR CARBONATED BEVERAGE CONTAINERS

BACKGROUND

Carbonated beverages, such as flavored and un-flavored carbonated soda water, beer, sparkling wines, etc., are typically stored under pressure in airtight containers. This is in part to maintain the beverage in a carbonated state, or at least to reduce the extent to which carbon dioxide escapes from the beverage.

Once the container has been opened, carbon dioxide tends to discharge from the beverage. The process of discharge can be slowed to a certain extent by resealing the container. However, after resealing, there is typically an enlarged, available headspace into which the carbon dioxide can discharge.

It is known that if the headspace can be decreased as the volume of the stored beverage decreases, the extent to which carbon dioxide is discharged or otherwise lost from the beverage may be reduced. Several devices have been introduced to help reduce the loss of carbon dioxide from carbonated beverages that are stored in deformable plastic containers including polyethylene terephthalate polymeric (PET) bottles.

For example, U.S. Pat. No. 8,074,567 discloses devices whose members form a hexagon around an enclosed container. The corners of the hexagon are pivotable, and one or more corners have a rotary lock that is intended to maintain the flattened shape of the hexagon to keep the container compressed. However, such devices may tend to buckle when only one corner of the hexagon utilizes the lock. With just one corner locked, the other five corners are still free to rotate and the hexagon can swell. As carbon dioxide escapes from the stored beverage, pressure increases inside the container, the container expands, and the headspace grows.

Certain proposed devices for compressing carbonated beverage containers rely on brute, manual force to compress both the device and the container held inside. Moreover, if the force is weak, the container may not budge; if the force is vigorous or swift, the container may flatten abruptly, causing a spill. The reliance on a substantial manual force may preclude some people, like kids, the elderly, people with physical disabilities, etc., from effectively using the devices. Furthermore, it is known that one can reduce even more of the loss of carbon dioxide from the stored beverage by compressing the container additionally after resealing it. The additional compression stiffens the walls of the container. As carbon dioxide escapes into the headspace and increases the pressure in the container, the taut walls yield less, decreasing the growth of the headspace. The additional compression also reduces folds, bends, or creases on the walls of the container, which could otherwise, under the increased internal pressure, expand the interior volume of the container and enlarge the headspace. The additional compression requires a more strenuous compressing force. The reliance by the noted devices on the strength of the external, manual force precludes some people from exploiting the additional compression.

In addition, some proposed devices for compressing carbonated beverage containers offer discrete levels of compression. For example, in U.S. Pat. No. 8,074,567, the rotary locks of each device fix the device into shapes that are incrementally more flattened. The levels of compression are quantized by the increments. So even when one compresses the container to the highest level possible without the beverage overflowing, considerable headspace can remain.

In the case of certain proposed devices, as the containers become flatter under compression the edges of the flattened containers may tend to wedge into the corners of the devices. This impedes the corners from closing down further, hindering further compression on the containers.

Moreover, it may be possible to ease the re-opening of some containers, e.g. those with screw caps, by decompressing the containers to some extent (less than fully released) beforehand. This phenomenon is generally unappreciated, or at least not taken advantage of, in proposed devices. Even though such devices and the containers held inside can be released from a compressed state, the release leaves the devices and the containers in a fully uncompressed state. Subsequent compression of the same containers requires re-compressing back to or past the previous compression level from the fully uncompressed state. This release to and subsequent re-compression from the fully uncompressed state waste more effort. They also wear more on the devices, shortening the operating lives of the devices.

In addition to the foregoing, the devices that have previously been proposed generally are bulky, complicated, cumbersome, difficult to use, and/or do not achieve the intended result.

SUMMARY

In accordance with one or more embodiments, a device and associated functionality ("system") are disclosed, which can be used in compressing a carbonated beverage container, maintaining the container in a compressed state, (e.g., during storage, especially after opening), and releasing the container from the compressed state when desired. The device is of simple construction and can be produced inexpensively. In addition, the system can be operated easily, even by individuals having limited strength or dexterity. Moreover, the device is compact, even when deployed to supply significant compression, such that it is convenient for use even in space limited settings like refrigerators.

In accordance with one or more aspects, a device and associated method are provided, which can be used in compressing a container containing a carbonated beverage. The device includes a compression assembly for receiving the container therein and applying a compressive force to at least one external surface of the container. The compression assembly has no more than four substantially rigid frame members pivotally interconnected by hinge connectors, such that the frame members define a central opening for receiving the container. The opening is expandable and contractible by operation of the hinge connectors. The device further includes a hinge controller, associated with a first hinge connector of the hinge connectors, for moving the first hinge connector to a selected position and resisting expansion forces so as to maintain the first hinge connector at the selected position.

It will be appreciated that such an assembly, formed by no more than four frame members interconnected by hinge connectors, can be controlled by operating a single one of the hinge connectors. In particular, if each of the hinge connectors has a single degree of rotational freedom, i.e., it is rotatable about a single axis, controlling the angular position of a hinge connector connecting proximal ends of the first and second frame members will control the position of distal ends of the first and second frame members. This, in turn, will control the positions of the third and fourth frame members as well as all of the hinge connectors. Accordingly, the state of the compression assembly and the compression applied to the container can be fully determined by controlling a single hinge connector. This allows for simple and positive control of the device.

In one or more embodiments, each of the frame members includes a bend oriented such that the frame members are concave internally towards the central opening. The bends of the frame members may be disposed adjacent those of the hinge connectors with decreasing angles as the central opening contracts. These bends reduce the overall length of the device, especially when the device is in a compressed state, thereby reducing the space consumed by the device in refrigerators or other limited storage areas. In addition, the bends reduce the likelihood of pinching and damaging the container.

A number of different mechanisms may be utilized to assist in compressing the container, maintaining the container in a compressed state, and releasing the container from the compressed state when desired. For example, a turn screw mechanism may be provided, with or without gears or other transmission mechanisms for providing/amplifying mechanical advantage, to control the first hinge connector. Such a turn screw facilitates application of the required force to compress the container, allows the container to be compressed to a desired degree that may be substantially infinitely variable, and allows for smooth application of the required force so that abrupt motions and spillage of the beverage are reduced. Alternatively or additionally, a motorized assembly for moving the first hinge connector may be provided. The motorized assembly may allow for automated compression and release of the first hinge connector. In this regard, one or more buttons or other user control elements may be provided to selectively compress the container or release the container from compression. For example, a first button may be operated to control the motor to compress the container and a second button may be operated to control the motor to release the container from compression. Alternatively, a single lever or similar element may be moved in first direction to effect compression and in second direction to release the container from compression.

Additional control elements may be provided to limit the range of motion or amount of force applied by such a motorized assembly. For example, a first limit switch may be provided to limit compression under operation of the motorized assembly. Such a limit switch may be associated with a sensing mechanism for sensing the amount of compression (or some related parameter) applied to the container. A second limit switch may be provided to limit the range of motion of the motorized assembly in relation to releasing the container from compression. For example, such a limit switch may be provided to prevent over-extension or damage to drive components.

The associated methodology for using the noted device involves placing a container in a central opening defined by the substantially rigid frame members of the compression assembly and operating the compression assembly to move the first hinge connector to a selected position. In the case of compressing the container, this will result in reducing a dimension of the central opening. Depending on the embodiment, the first hinge connector may be operated manually or by use of a motorized assembly as described above. The amount of compression may be determined by monitoring a progressing reduction in the headspace and/or by sensing an amount of compression force applied to the container. In addition, the process of compressing may involve compressing the container by a first amount, closing the container (e.g., by screwing on a cap), and then further compressing the container. The methodology may further involve releasing the container from compression when desired, e.g., to assist in removing a cap and to consume the beverage. Such releasing may generally be accomplished by reversing the process for compressing the container. For example, a turn screw may be operated to expand a dimension of the central opening or a motorized mechanism may be operated in this regard. In certain embodiments, an alternate mechanism may be provided for releasing compression, though a gradual release will generally be preferred.

As noted above, one of the advantages of one or more aspects is that compression of a container, and release thereof, can be effected by controlling operation of a single hinge connector connecting first and second frame members. Other embodiments can be provided to achieve this advantage. For example, the distal ends of the first and second frame members may be connected by a flexible member such as a flexible band. The band can then be paid out or retracted to control the position of the hinge connector and the size of the central opening holding the container. In this manner, compression of the container and release of the container from compression can be controlled by controlling operation of a single hinge connector, thus facilitating simple construction and control of the device as described above.

For a more complete understanding of what is disclosed and further advantages of one or more aspects, reference is now made to the following drawings and detailed description.

DRAWINGS

DETAILED DESCRIPTION

In accordance with one or more embodiments a device and associated methodology are disclosed, which can be used in compressing a carbonated beverage container, maintaining the container in a compressed state, and releasing the container from the compressed state when desired. The device can be controlled by operating a single hinge connector which allows for simple construction and operation and also facilitates certain manual and motorized operation as described below. The following description illustrates some of the embodiments and the advantages of one or more aspects. However, it will be appreciated that the scope of the embodiments is not limited to the examples given.

Figure 1A:
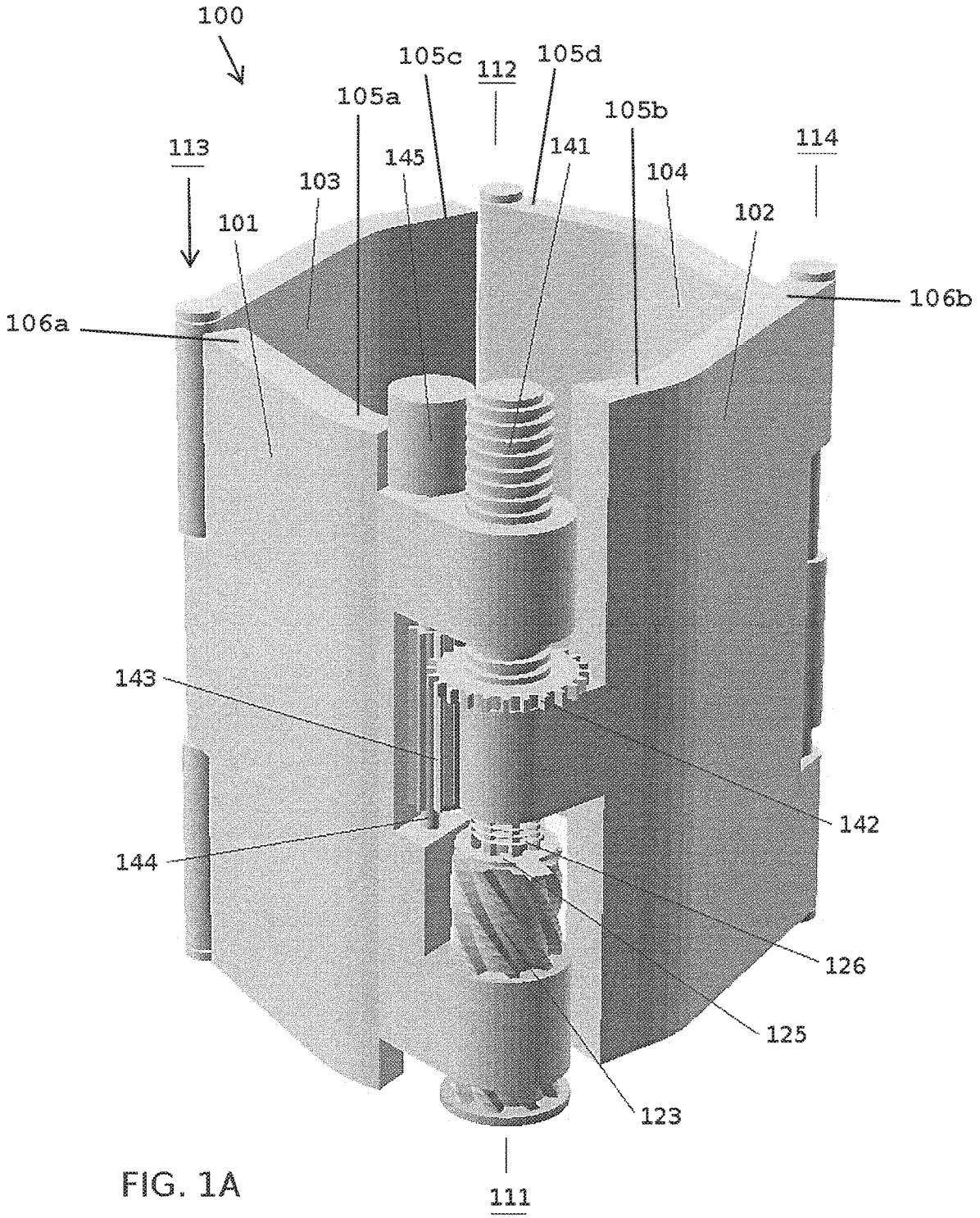
FIG. 1A is a perspective view of a compression device constructed in accordance with one embodiment.
Figure 1B:
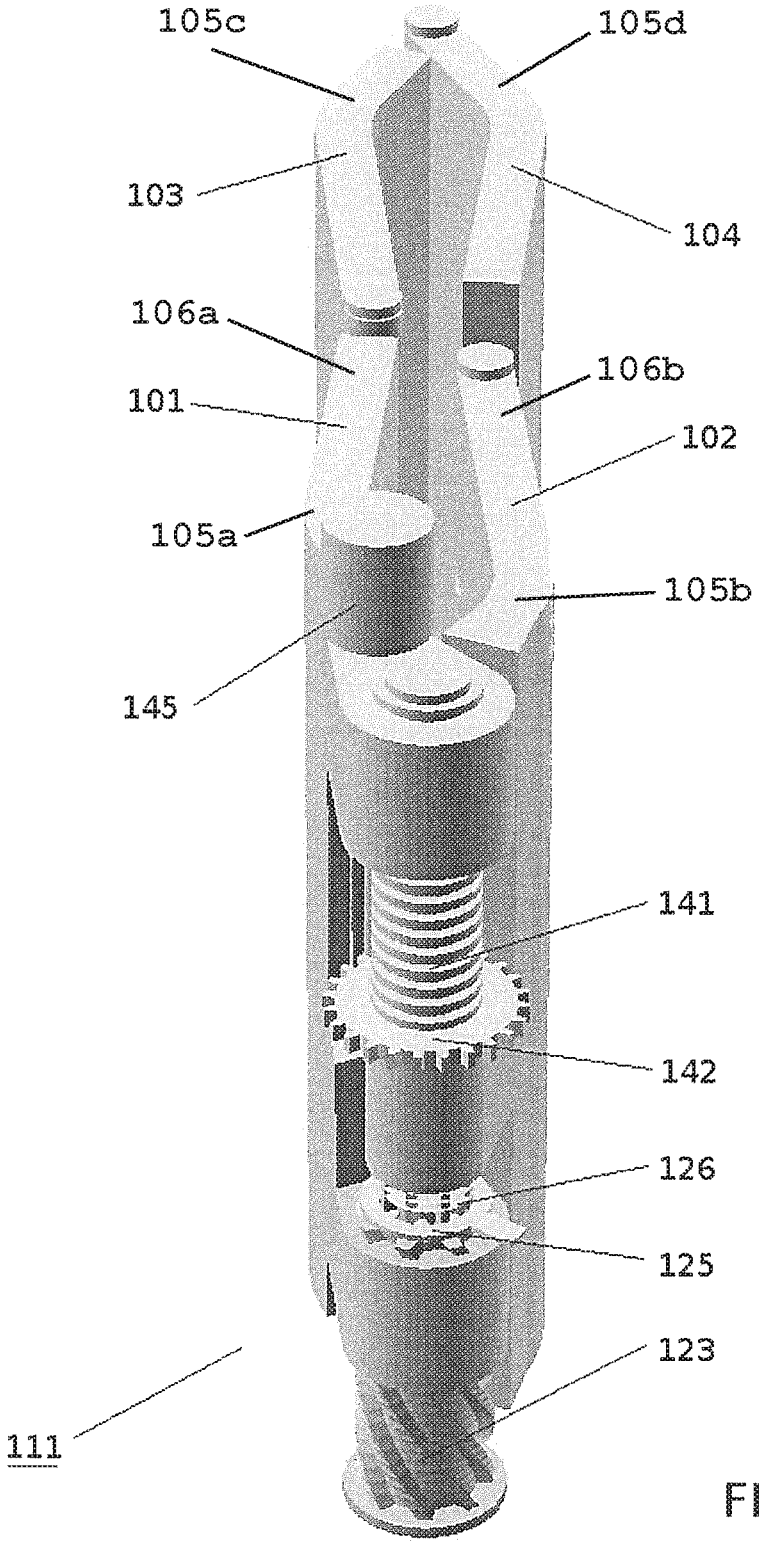
FIG. 1B is a perspective view showing the compression device of FIG. 1A in a compressed state.
Figure 1C:
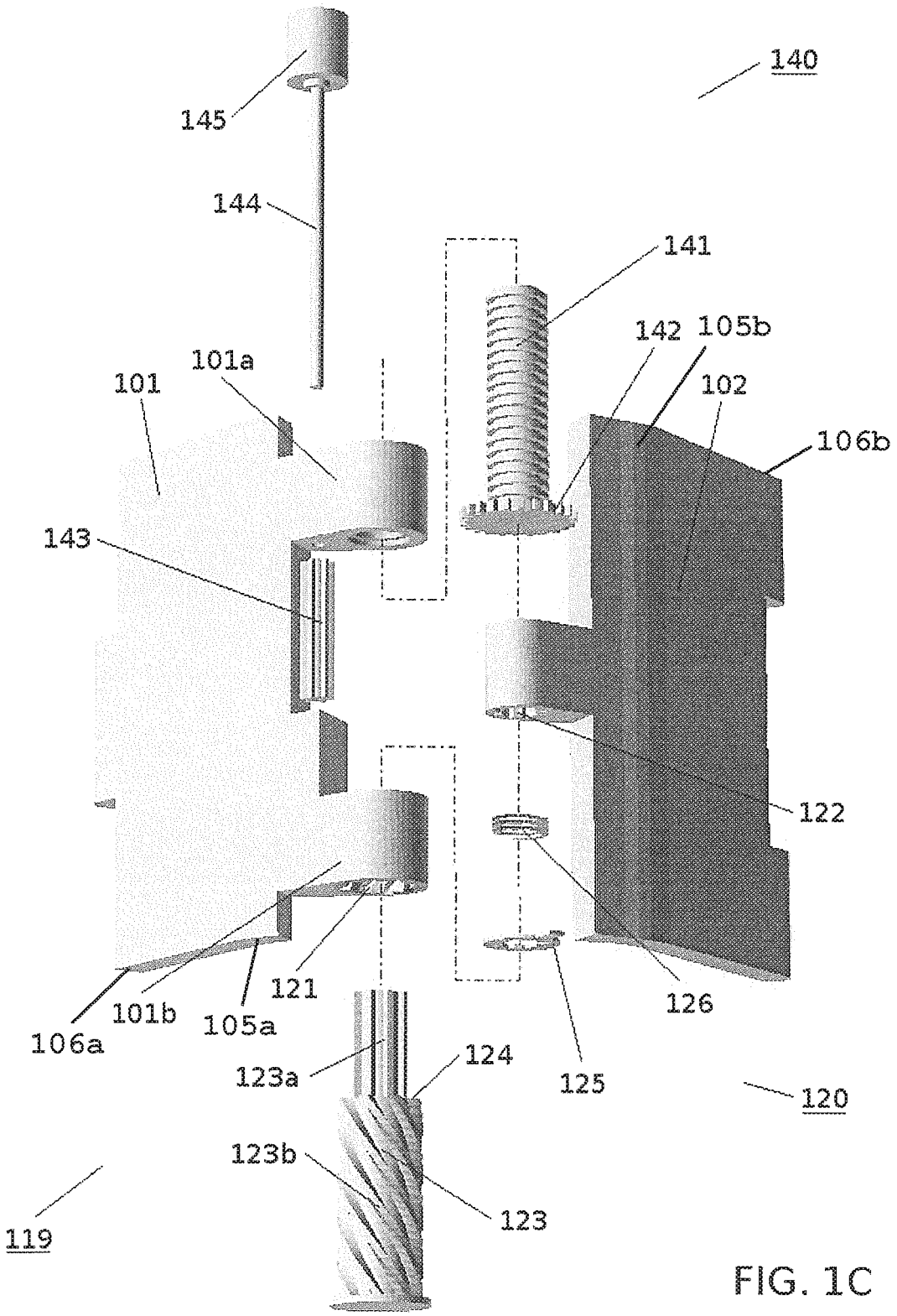
FIG. 1C is an exploded perspective view showing a hinge controller and a first hinge connector of the device of FIG. 1A.
Figure 1D:
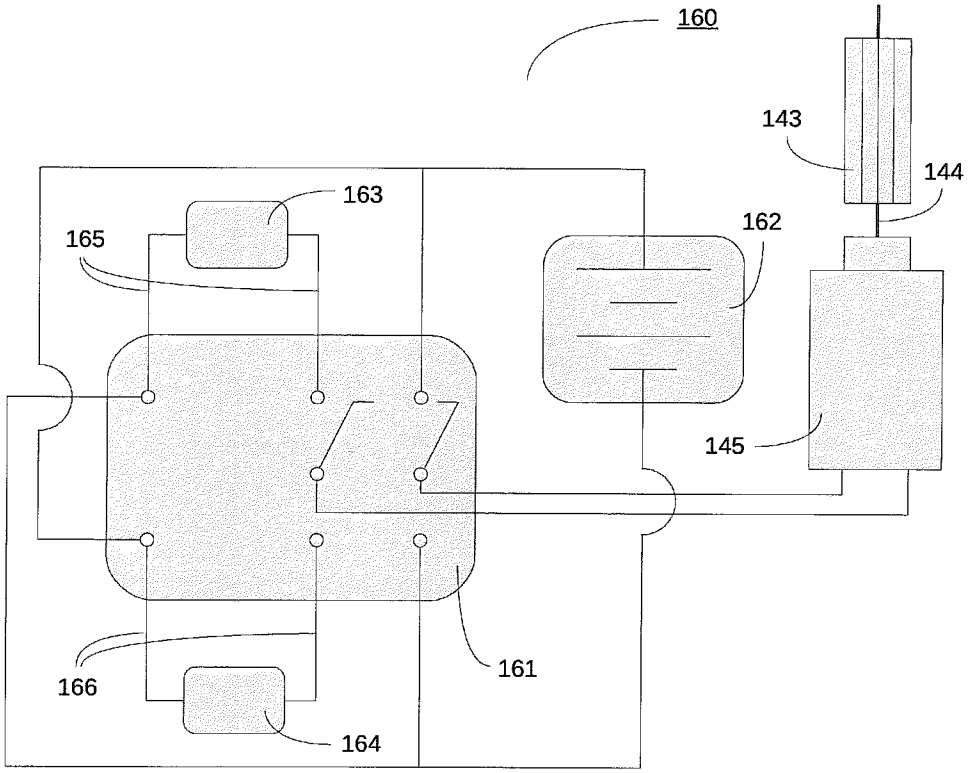
FIG. 1D is a circuit diagram illustrating a control circuit of the device of FIG. 1A.

FIG. 1A shows a perspective view of a compression device 100 constructed in accordance with a first embodiment. Compression device 100 comprises a first frame 101, a second frame 102, a first linking frame 103, and a second linking frame 104. The frames are joined together, forming a quadrilateral enclosure or compression assembly that accepts a PET bottle.

In the illustrated embodiment, first frame 101 and second frame 102 each have an inwardly curled end 105*a*, 105*b*, respectively (hereafter 105 unless specifically referenced). The curled ends 105*a*, 105*b* are pivotably joined together by a first hinge connector 111. First linking frame 103 and second linking frame 104 each have an inwardly curled end 105*c*, 105*d*, respectively (hereafter 105 unless specifically referenced). The curled ends 105*c*, 105*d* of the linking frames 103 and 104 are pivotably joined together by a second hinge connector 112. First frame 101 is pivotably joined to first linking frame 103 by a third hinge connector 113. Second frame 102 is pivotably joined to second linking frame 104 by a fourth hinge connector 114.

Referring to FIGS. 1A-1D, a hinge controller 119 is associated with first hinge connector 111. Hinge controller 119 comprises a conversion mechanism or assembly 120 and a drive mechanism or assembly 140. The illustrated conversion mechanism 120 comprises a first bore 121, a second bore 122, and a spline shaft 123. Spline shaft 123 is cylindrical and has an upper portion 123*a* and a lower portion 123*b*. The upper portion 123*a* has external splines that are vertical. The lower portion 123*b* has external splines that are helical. The curled end 105*a* of first frame 101 has an upper protrusion 101*a* and a lower protrusion 101*b*. The lower protrusion 101*b* has a vertical cylindrical channel that forms first bore 121. First bore 121 has internal grooves that are helical and which mate with the helical external splines of spline shaft 123. The curled end 105*b* of second frame 102 has a vertical cylindrical channel that form second bore 122. Second bore 122 has internal grooves that are vertical and which mate with the vertical external splines of spline shaft 123. The upper portion 123*a* of spline shaft 123 sits inside second bore 122. The lower portion 123*b* of spline shaft 123 slides inside first bore 121. Through first bore 121 and second bore 122, spline shaft 123 joins together first frame 101 and second frame 102. In the illustrated embodiment, first hinge connector 111 comprises the lower protrusion 101*b* of first frame 101, the curled end 105*b* of second frame 102, spline shaft 123, first bore 121, and second bore 122.

In the illustrated embodiment, the diameter of the upper portion 123*a* of spline shaft 123 is less than that of the lower portion 123*b*. During assembly, the upper portion 123*a* can traverse through first bore 121 without being engaged or obstructed by the helical grooves of first bore 121. The bottom end of spline shaft 123 is capped to stop spline shaft 123 from over-traveling upwards through first bore 121. Corresponding to the difference in the diameters, there is a circular ledge 124 where the upper portion 123*a* meets the lower portion 123*b*. A washer 125 (FIG. 1C) sits on top of circular ledge 124. A spring 126 sits on top of washer 125 and underneath second bore 122. The inner edge of washer 125 is serrated. The serration matches the vertical splines of the upper portion 123*a* of spline shaft 123, keeping washer 125 from rotating with respect to spline shaft 123 and second frame 102. The outer edge of washer 125 has a tab that extends outward, perpendicular to second frame 102.

Drive mechanism 140 comprises a compression screw 141, a compression gear 142, a drive gear 143, a motor shaft 144, a motor 145, and an electrical system 160. Compression screw 141 threads through a vertical cylindrical channel in the upper protrusion 101*a* of first frame 101. The vertical cylindrical channel in the upper protrusion 101*a* has internal threads that mate with the threads of compression screw 141. Compression screw 141 pushes down on second frame 102 where second bore 122 engages spline shaft 123. The upper portion 123*a* of spline shaft 123 is shorter than second bore 122 so that compression screw 141 pushes on second frame 102 instead of directly on spline shaft 123. Mounted on the bottom end of compression screw 141, compression gear 142 mates with drive gear 143. Drive gear 143 is mounted on motor shaft 144 of motor 145. Motor 145 is mounted on the top of first frame 101. Motor shaft 144 goes through the upper protrusion 101*a* of first frame 101 and into the lower protrusion 101*b* of first frame 101.

Electrical system 160 comprises a switch 161, a battery 162, a compression limit switch 163 (FIG. 1D), a decompression limit switch 164, compression limit wires 165, and decompression limit wires 166. Switch 161 and battery 162 are mounted on the outside face of first frame 101. Electrical wires connect battery 162 to switch 161 and switch 161 to motor 145. Switch 161 has two push buttons: a compression button and a decompression button. Wires 165 and wires 166 connect switch 161 with limit switch 163 and limit switch 164 respectively. Limit switch 163 is mounted on the outside face of second frame 102 above the extended tab of washer 125. Limit switch 164 is mounted on the outside face of the upper protrusion 101*a* of first frame 101 above compression gear 142.

Compression device 100 can be partially assembled in the following way. Compression gear 142 can be first mounted onto compression screw 141. Compression screw 141 can then be threaded into the upper protrusion 101*a* of first frame 101 from below. Compression screw 141 can then be driven all the way up to make room for spline shaft 123 and second frame 102. Spline shaft 123 can then be inserted into first bore 121 from below, until the helical splines of spline shaft 123 engage the helical grooves of first bore 121. Spline shaft 123 can then be screwed through first bore 121 until the upper portion 123*a* of spline shaft 123 fully emerges from the top opening of first bore 121. Washer 125 can then be placed on circular ledge 124 and spring 126 can be placed on washer 125. The upper protrusion 101*a* and the lower protrusion 101*b* of first frame 101 are far apart. There is clearance for the curled end 105*b* of second frame 102 to pass between the top of spline shaft 123 and the bottom of compression gear 142. The curled end 105*b* of second frame 102 can then be placed in the clearance, and second bore 122 can be mounted onto the upper portion 123*a* of spline shaft 123 while keeping close together the non-curled end 106*a* of first frame 101 and the non-curled end 106*b* of second frame 102. First hinge connector 111 can then be opened to approximately 90 degrees (as defined by the angle between the first and second frames 101 and 102) and compression screw 141 can be lowered onto second frame 102.

In operation, a user leaves the PET bottle open and puts it in the enclosure. The user then presses the compression button of switch 161. Motor 145 turns drive gear 143 which turns compression gear 142. Compression gear 142 turns compression screw 141 and lowers it. Compression screw 141 pushes down on second frame 102 which pushes down on spring 126 and washer 125 which urge spline shaft 123 downward. The helical splines of spline shaft 123 slide against the helical grooves of first bore 121. Spline shaft 123 moves downward while rotating with respect to first bore 121 and first frame 101, decreasing the joint angle of first hinge connector 111. As the angle decreases, the quadrilateral enclosure flattens, compressing the PET bottle.

The user keeps pressing the compression button of switch 161 until little headspace remains in the PET bottle, and then releases the compression button of switch 161 and closes the cap of the PET bottle tightly. The user then resumes pressing the compression button of switch 161 to compress the PET bottle further. As pressure builds up in the PET bottle, bulging force increases on the enclosure from the PET bottle, and through spline shaft 123, pressure increases across spring 126 and shortens it. When the latter pressure exceeds a threshold, the extended tab of washer 125 triggers limit switch 163. Limit switch 163 disconnects compression limit wires 165 electrically, opening the circuit of switch 161 and cutting off power to motor 145. The user then releases the compression button of switch 161. Compression screw 141 holds off second frame 102 and spline shaft 123, stopping them from moving upward, and maintaining compression on the PET bottle.

To release compression, the user presses the decompression button of switch 161. Motor 145 turns drive gear 143 which turns compression gear 142. Compression gear 142 turns compression screw 141 and raises it. Compression screw 141 decreases the downward pressure on second frame 102, spring 126, and spline shaft 123. Pressure in the PET bottle is now greater than the external compression. As the PET bottle decompresses and bulges against the enclosure, the joint angle of first hinge connector 111 increases. The helical splines of spline shaft 123 slide against the helical grooves of first bore 121. While rotating with respect to first bore 121 and first frame 101, spline shaft 123 moves upward. Through spring 126, spline shaft 123 pushes second frame 102 up against compression screw 141. The user keeps pressing the decompression button of switch 161 until the PET bottle is slack. Then the user can easily open the cap of the PET bottle.

Thus, hinge controller 119 of the compression device not only maintains compression on the PET bottle, but also advances compression. The compression device generates a steady, measured, and strong compressing force, letting more people, including kids, the elderly, people with physical disabilities, etc., use it effectively. In addition, the compression device lets more people exploit the additional compression after their closing the PET bottle.

The compression device provides continuous levels of compression, i.e., it is substantially infinitely adjustable. As the PET bottle is flattened continuously, the headspace is reduced continuously. When the compression is halted, less headspace remains in the PET bottle, decreasing the loss of carbon dioxide from the beverage. The compression device also offers continuous decompression. Decompressing beforehand makes it easier to re-open the PET bottle.

Allowing the compression device to over-compress may damage the device, burst the PET bottle, or both. Limit switch 163, spring 126, and washer 125, working together, mitigate these chances by cutting off power to motor 145 when the compression pressure is over a safety limit. In addition, manufacturers can determine beforehand a more optimal compression pressure for the PET bottle and adjust limit switch 163, spring 126, and washer 125 accordingly. So when the more optimal compression pressure is reached, the compression device stops automatically. Thus limit switch 163, spring 126, and washer 125 both provide a safety check and make the compression device more convenient to use.

Pressing the decompression button of switch 161 raises compression screw 141 and compression gear 142. When raised near the upper protrusion 101*a* of first frame 101, compression gear 142 triggers limit switch 164. Limit switch 164 disconnects decompression limit wires 166 electrically, opening the circuit of switch 161 and cutting off power to motor 145. Limit switch 164 stops compression screw 141 and compression gear 142 from traveling too far upward, mitigating the chance of damaging the compression device.

The compression device utilizes a quadrilateral enclosure. The four sides of the enclosure are articulate and pivotable, allowing the enclosure to flatten as the PET bottle flattens and to bulge as the PET bottle bulges. The compression device takes up less additional space around the PET bottle. It is more space-efficient. This efficiency is an under-appreciated but important advantage, especially as the PET bottle with beverage contained inside is stored usually in a limited space, like a refrigerator.

As hinge controller 119 decreases the angle of first hinge connector 111, the quadrilateral enclosure flattens. Furthermore, the enclosure holds its shape against the outward pressure from the PET bottle because hinge controller 119 blocks the angle of first hinge connector 111 from increasing. As hinge controller 119 eases on the block, the angle of first hinge connector 111 becomes able to increase and the quadrilateral enclosure able to bulge. Thus, acting from one corner of the quadrilateral enclosure and acting on just one of the hinge connectors, hinge controller 119 is able to control, advance, and maintain compression and decompression. This contributes to simpler construction and less expensive production of the compression device.

Through the helical splines of spline shaft 123 and the helical grooves of first bore 121, conversion mechanism 120 translates vertical movement of an actuator, the curled end 105*b* of second frame 102 in this case, into angular reposition, i.e. changes of the joint angle, of first hinge connector 111, and vice versa. Conversion mechanism 120 converts the downward force on second frame 102 into a closing torque that decreases the angle of first hinge connector 111. Conversely, it converts an opening torque that increases the angle of first hinge connector 111 into an upward force on second frame 102. There is no longer a need for an external lateral force to compress. Through conversion mechanism 120, a vertical force along the side of the PET bottle brings about compression. Furthermore, the replacement of the lateral force by the vertical force facilitates drive mechanism 140, which also provides mechanical advantage, being compactly integrated into the compression device, making the device more space-efficient.

As the PET bottle becomes more flattened, the edges of the bottle becomes more pronounced. The edges would tend to wedge in the two opposite, closing-down corners of the quadrilateral enclosure of the compression device, had the two corners not had curled sides. The curled ends 105 of frames 101, 102, 103, and 104, which form the two corners, curl around and accommodate the edges of the PET bottle, curtailing the latter from impeding further compression.

Figure 2:
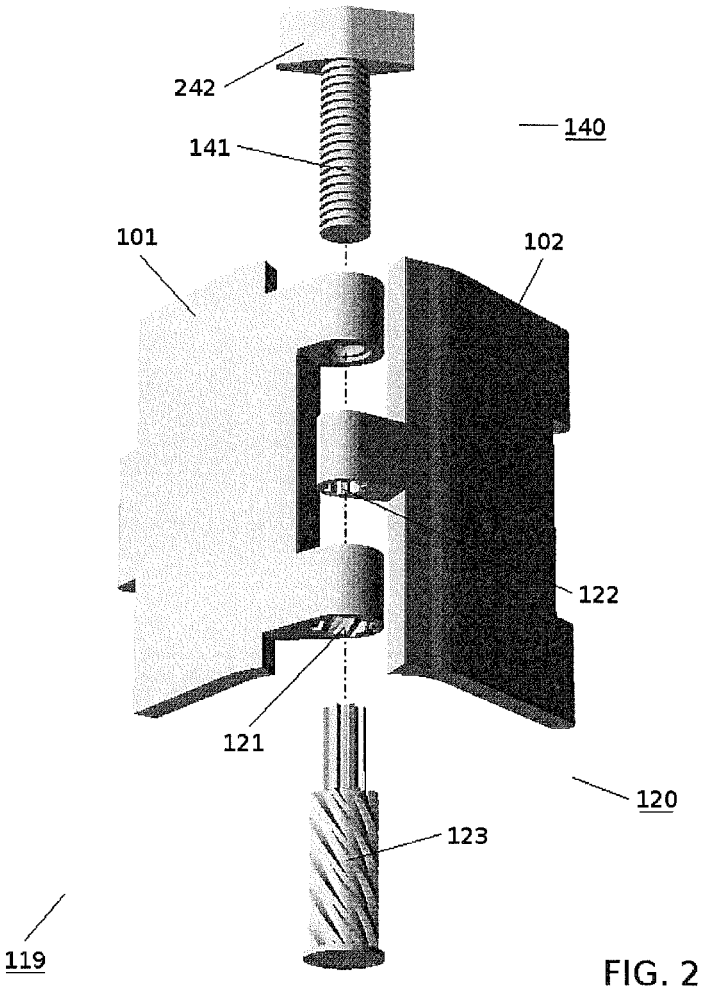
FIG. 2 is an exploded perspective view showing a hinge controller and a first hinge connector of a compression device constructed in accordance with another embodiment.

FIG. 2 shows a compression device 200 constructed in accordance with an alternate embodiment that allows for manual operation. The elements of the device 200 that correspond to elements of the compression device 100 of FIGS. 1A-1D are identified by corresponding numerals. In the illustrated device 200, drive mechanism 140 comprises a compression screw 141 and a screw handle 242. Screw handle 242 is mounted on the top end of compression screw 141 above the upper protrusion 101*a* of first frame 101. Washer 125 and spring 126 of FIGS. 1A-1D are absent. The bottom end of second bore 122 sits directly on circular ledge 124. The upper portion 123*a* of spline shaft 123 is shorter than, as long as, or longer than second bore 122. Compression screw 141 pushes either on second frame 102 or directly on spline shaft 123.

In operation, the user turns screw handle 242 in one direction to lower compression screw 141, flattening the quadrilateral enclosure and compressing the PET bottle. The user turns screw handle 242 in the other direction to raise compression screw 141, allowing the quadrilateral enclosure to bulge and decompressing the PET bottle.

Substantial mechanical advantage is achievable with the compression device, for example, by appropriate selection of the size of spline shaft 123, the pitch of its helical splines, the size of compression screw 141, the pitch and start of its screw threads, etc. The compression device turns a possibly weak, unsteady manual force into a steady, measured, and strong compressing force, letting more people, including kids, the elderly, people with physical disabilities, etc., use it effectively. In addition, the compression device lets more people exploit the additional compression after closing the PET bottle.

Many other variations are possible. For example, first hinge connector 111, hinge controller 119, conversion mechanism 120, and drive mechanism 140 can be relocated to one of the other corners, with non-curled sides, of the quadrilateral enclosure and the PET bottle is compressed by increasing the angle of first hinge connector 111; the curled ends 105 of frames 101, 102, 103, and 104 can be straight instead of curled; the compression device can be used on other deformable containers in addition to PET bottles or on other aerated liquids in addition to carbonated beverages; the quadrilateral enclosure need not be a rhombus or a parallelogram; the enclosure can have more sides than being quadrilateral, with conversion mechanism and/or drive mechanism at additional corner or corners; feet beneath the compression device can be added to increase stability; instead of spline shaft, conversion mechanism 120 can use pneumatic, hydraulic, or gear systems, or shafts with other types of ridges or of other shapes, like square, triangle, etc.

Figure 3A:
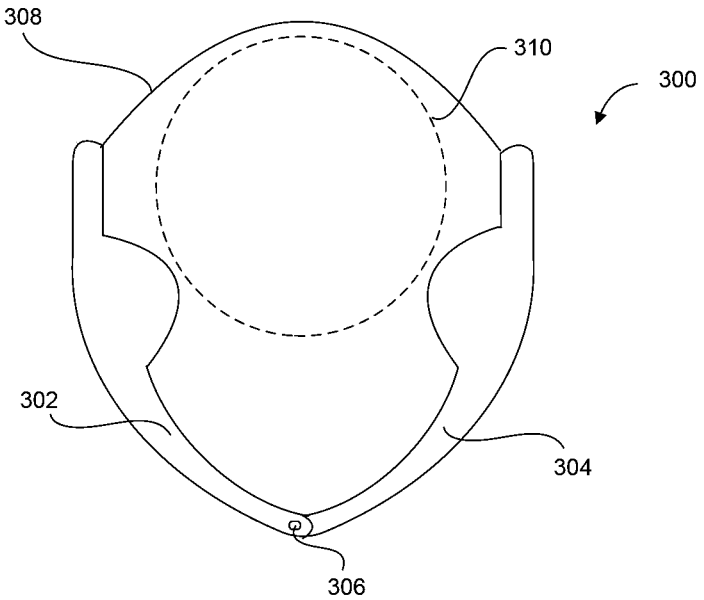
FIGS. 3A and 3B are top and partial side views, respectively, of a compression device constructed in accordance with a further embodiment.
Figure 3B:
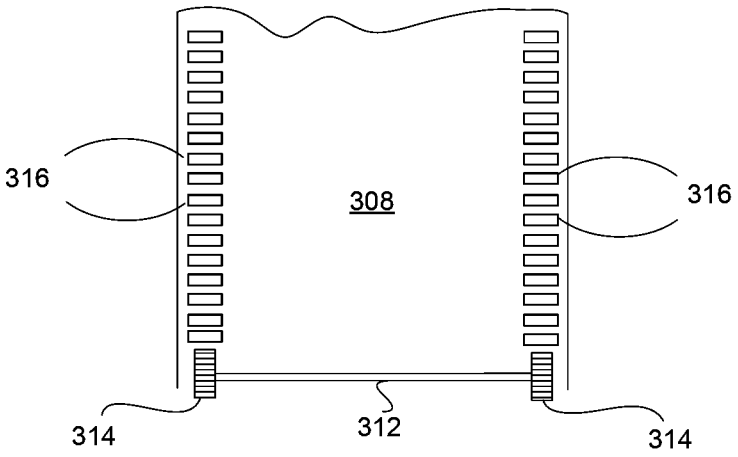

As noted above, certain advantages of one or more aspects relate to the ability to compress a container and release the container from compression by controlling a single joint or hinge connector. It will be appreciated that other embodiments are possible for achieving the advantages. FIGS. 3A-3B illustrate a compression device 300 constructed in accordance with one such alternative embodiment.

The illustrated device 300 includes a first frame member 302 and a second frame member 304 connected by a first hinge connector 306. A strap or band 308 is threaded through slits at the distal ends of the frame members 302 and 304. The band 308 may be formed from flexible plastic or other flexible fabric. A carbonated beverage container 310 is received in a central opening defined by the band 308 and frame members 302 and 304. The size of this opening can be reduced by retracting the band 308 into the frame members 302 and 304 thereby applying a compressive force to the container 310. Conversely, the size of the opening can be increased by paying out the band 308 from the frame members 302 and 304 so as to reduce compression or to release the container 310. Such paying out or retracting of the band 308 can be accommodated by spooling of the band 308 or overlapping of the band 308 within the frame members 302 and 304.

Various mechanisms may be provided for controlling such movement of the band 308. FIG. 3B illustrates one such mechanism. In the illustrated embodiment, the band 308 includes a number of openings 316. The openings 316 are received within sprockets of one or more sprocket wheels 314. The sprocket wheels 314 are mounted on a shaft 312. Rotation of the shaft 312 in one direction will result in paying out of the band 308 and rotation in the other direction will result in retraction of the band 308. It will be appreciated that the shaft 312 can be operated manually or automatically using similar drive mechanisms as described above in connection with FIGS. 1A-1D and 2. In addition, the shaft 312 can include a ratcheting or similar mechanism to facilitate maintaining and releasing the device 300, respectively, in and from a compressed state. For example, the ratcheting mechanism can have two pawls that are offset from each other so that when the first pawl catches a tooth of the ratcheting mechanism the second pawl is on the gently sloped edge of another tooth, and vice versa. To pay out the band 308 in a controlled and gradual fashion, a user can release each of the two pawls briefly and alternately, each time allowing the shaft 312 to rotate and to pay out the band 308 a little until a tooth of the ratcheting mechanism catch the other pawl.

Figure 4:
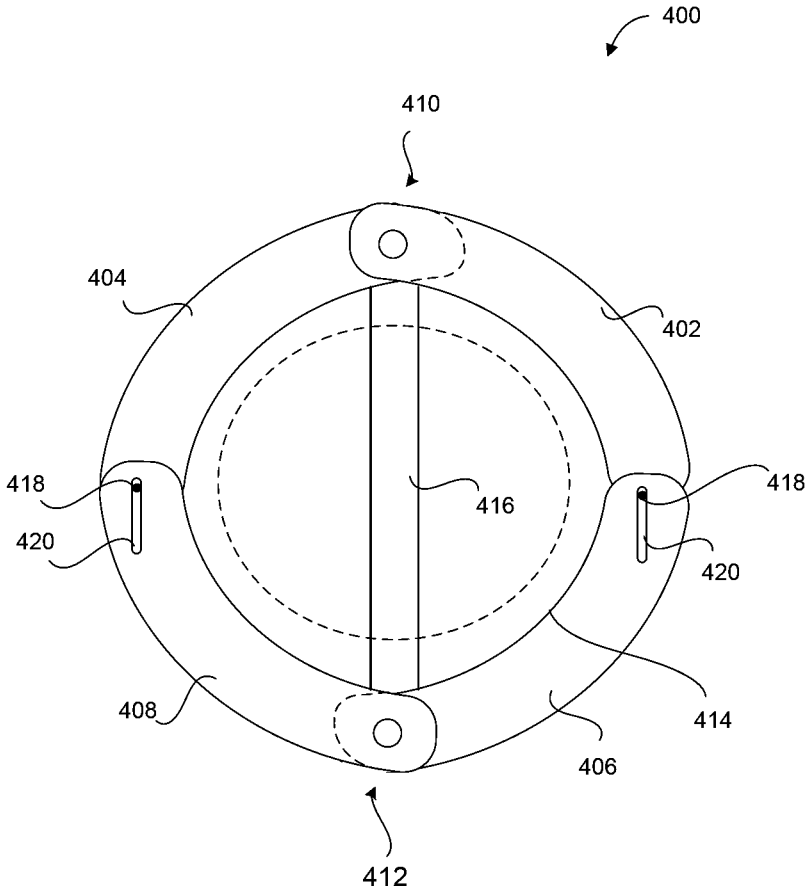
FIG. 4 is a top view of a compression device constructed in accordance with a still further embodiment.

FIG. 4 illustrates a compression device 400 constructed in accordance with a still further embodiment. The device 400 includes a first frame member 402, a second frame member 404, a third frame member 406, and a fourth frame member 408. The first and second frame members 402 and 404 are pivotally connected by a first hinge connector 410. The third and fourth frame members 406 and 408 are pivotally connected by a second hinge connector 412.

The first frame member 402 and third frame member 406 are connected by way of pin a 418 that can move within a slot 420. For example, the pin 418 may be connected to the first frame member 402 and the slot 420 may be formed in the third frame member 406. Similarly, the second frame member 404 and fourth frame member 408 are connected by a pin 418 and a slot 420. A carbonated beverage container 414 is received in a central opening defined by the frame members 402, 404, 406, and 408. Furthermore, the first and second hinge connectors 410 and 412 are connected by a frame 416 which maintains a constant distance of separation between the first and second hinge connectors 410 and 412. For example, the frame 416 may be shaped so as to extend around the bottom or sides of the container 414.

The angle of the first hinge connector 410 can be decreased by moving the pins 418 within the slots 420 towards the second hinge connector 412. In this manner, the frame members 402, 404, 406, and 408 can be operated to reduce the size of the central opening thereby compressing the container 414, without changing the distance between the hinge connectors 410 and 412. Similarly, this process can be reversed to reduce compression or to release the container 414. As illustrated above, all of this can be accomplished by controlling just one of the hinge connectors, in this case through controlling the movement of the pins 418 in the slots 420. The device 400 may be dimensioned so as to accommodate expansion of the container along one axis when it is compressed with respect to another axis. For example, the space between the hinge connectors 410 and 412 may be somewhat greater than the uncompressed diameter of the container 414. The device 400 can further include a ratcheting or similar mechanism, analogous to that described above in connection with FIGS. 3A-3B, to lock the positions of the pins 418 relative to the slots 420 and to allow a controlled and incremental retreat of the pins 418 in the slots 420.

Figure 5:
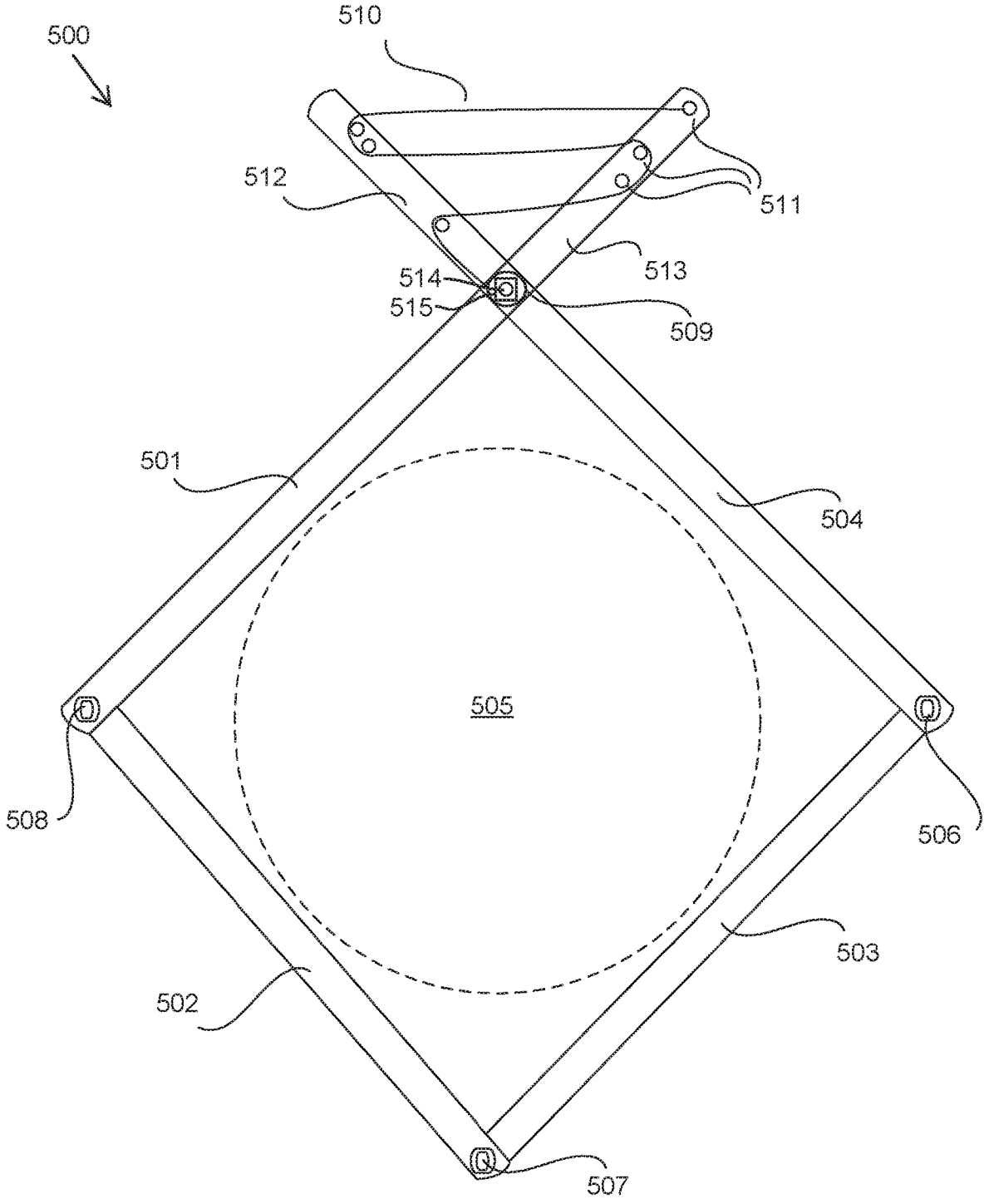
FIG. 5 is top view of a compression device constructed in accordance with yet another embodiment.

FIG. 5 shows a compression device 500 constructed in accordance with yet another alternative embodiment.

The illustrated device 500 includes frame elements 501, 502, 503, and 504 that are hingedly connected by hinge connectors 506, 507, 508, and 509. A carbonated beverage container 505 is received in a central opening defined by the frame elements 501, 502, 503, and 504. In the illustrated embodiment the hinge connector 509 is directly controlled by lever arms 512 and 513, which may be extensions of the frame elements 501 and 504.

The device 500 can be compressed and maintained in a compressed state by operation of a band or bands 510. In the illustrated embodiment, the band 510 is anchored, at one end, to the lever arm 513 and, at the other end, to a spool 514 disposed at the hinge connector 509. One or more pins or pulleys 511 are placed on the lever arms 512 and 513. The band 510 are threaded through the pulleys 511 back and forth between the lever arms 512 and 513. The spool 514 is connected to a turn handle 515. Operating the turn handle 515 spools in the band 510 into the spool 514, draws together the lever arms 512 and 513, and closes the hinge connector 509, compressing the device 500 and the container 505. It will be appreciated that the spool 514 can also be operated using a motorized assembly similar to that described above in connection with FIGS. 1A-1D. In addition, the spool includes a ratcheting or similar mechanism, similar to that described above in connection with FIGS. 3A-3B, for locking and incrementally releasing the spool 514.

In this manner, the container 505 can be compressed by closing the hinge connector 509 which is achieved through spooling in the band 510 and moving the lever arms 512 and 513 close together. The container can be maintained in such a compressed state and later released in a controlled and gradual fashion, respectively, by locking the hinge connector 509 and later releasing it through the included ratcheting or similar mechanism mentioned above. As illustrated in the embodiment, a hinge controller, in this case comprising the band 510, the pulleys 511, the lever arms 512 and 513, the spool 514, and the turn handle 515, can extend external to the envelope of the frame elements 501, 502, 503, and 504 that contain and compress the container 505. Furthermore, the hinge controller can effect the control over the hinge connector 509 from outside the envelope.

It will be appreciated that any of the devices described above can be provided as an integral part of a carbonated beverage container or as an aftermarket product for use with existing carbonated beverage containers. The devices may be provided in a variety of sizes to accommodate containers of different sizes.

The foregoing description has been presented for purposes of illustration and description. Furthermore, the description is not intended to limit the embodiments to the form disclosed herein. Consequently, variations and modifications commensurate with the above teachings, and skill and knowledge of the relevant art, are within the scope of the embodiments. The embodiments described hereinabove are further intended to explain best modes known of practicing what is disclosed and to enable others skilled in the art to utilize what is disclosed in such or other embodiments and with various modifications required by the particular application(s) or use(s) thereof. It is intended that the appended claims be construed to include alternative embodiments to the extent permitted by the prior art.

What is claimed:

1. A beverage container compressing apparatus, comprising:

a compression assembly configured to receive a beverage container therein and applying a compressive force to at least one external surface of said container, said external surface bounding a beverage containing space of said container, said compression assembly including no more than four frame members pivotally interconnected by hinge connectors such that said frame members define a central opening configured to receive said container, said central opening being expandable and contractible by operation of said hinge connectors independent of any change of a circumference of said central opening; and a hinge controller directly connected to a first hinge connector of said hinge connectors, said first hinge connector interconnecting a first frame member and a second frame member of said frame members, said hinge controller being operative to exert a force directly on said first hinge connector so as to provide relative angular movement between said first and second frame members independent of any separate force applied to said first and second frame members, said hinge controller configured to move said first hinge connector to a first selected position, whereby said first hinge connector disposes said no more than four frame members in a first relative angular orientation defining a first configuration of said central opening, and said hinge controller is operable to move said first hinge connector to a second selected position that disposes said no more than four frame members in a second relative angular orientation defining a second configuration of said central opening.

2. The apparatus as set forth in claim 1, wherein each of said frame members includes a bend, said bend being oriented such that said frame member is concave inwardly towards said central opening.

3. The apparatus as set forth in claim 2, wherein each said bend of each said frame member is disposed adjacent to a respective hinge connector of said hinge connectors, wherein an angle between the frame members interconnected by said respective hinge connector decreases when said central opening contracts.

4. The apparatus as set forth in claim 1, wherein said hinge controller comprises a manually operated mechanism configured to move said first and second selected positions.

5. The apparatus as set forth in claim 4, wherein said manually operated mechanism comprises a turn screw configured to move said first hinge connector.

6. The apparatus as set forth in claim 1, wherein said hinge controller comprises a motorized assembly configured to move said first hinge connector to said first and second selected positions.

7. The apparatus as set forth in claim 6, further comprising a limit switch operative to limit compression of said container under operation of said motorized assembly.

8. The apparatus as set forth in claim 6, wherein said motorized assembly is operative to release said first hinge connector from said first and second selected positions.

9. The apparatus as set forth in claim 8, further comprising a limit switch operative to limit a range of motion of said motorized assembly in relation to reducing compression on said container.

10. The apparatus as set forth in claim 1, wherein said hinge controller comprises a linkage between a source of a first force for compressing said container, and a predetermined location for applying a second force, responsive to said first force, to said first hinge connector, said linkage providing a mechanical advantage such that said second force is greater than said first force.

11. The apparatus as set forth in claim 1, wherein said hinge controller is operative to resist expansion forces so as to maintain said first hinge connector at any position of a continuous range of positions.

12. The apparatus as set forth in claim 1, wherein said hinge controller includes a translation element configured to translate between a vertical displacement of an actuator and an angular reposition of said first hinge connector.

13. A beverage container compressing apparatus comprising:

a compression assembly configured to receive a beverage container therein and apply a compressive force to at least one external surface of said container, said external surface bounding a beverage containing space of said container, said compression assembly including at least first and second frame members pivotally interconnected by a first hinge connector, and a compression subassembly, said compression subassembly extending between said first and second frame members around said container, configured to compress said container and release said container from compression in coordination with movement of said first hinge connector, wherein said compression assembly defines an opening configured to receive a body of said container and said compression assembly is operative to selectively expand and contract a dimension of said opening independent of any change of a circumference of said opening; and a hinge controller directly connected to said first hinge connector, said hinge controller configured to maintain said first hinge connector in a selected position where said container is in compression and resist expansion forces associated with said compression, wherein, in said selected position, said first hinge connector disposes said first and second frame members in a fixed relative angular orientation and said dimension of said opening is fixed, said hinge controller being operative to exert force directly on said first hinge connector so as to resist relative angular movement between said first and second frame members, caused by said expansion forces, independent of any separate force applied to said first and second frame members, whereby said hinge controller resists expansion forces so as to maintain said first hinge connector at said selected position.

14. The apparatus as set forth in claim 13, wherein said compression subassembly comprises an articulated structure including third and fourth frame members interconnected by a second hinge connector.

15. The apparatus as set forth in claim 13, wherein each of said first and second frame members includes a bend, said bend being oriented such that said frame member is concave inwardly towards said container.

16. The apparatus as set forth in claim 13, wherein said hinge controller comprises a manually operated mechanism configured to move said first hinge connector to said selected position.

17. The apparatus as set forth in claim 16, wherein said manually operated mechanism comprises a turn screw configured to move said first hinge connector.

18. The apparatus as set forth in claim 13, wherein said hinge controller comprises a motorized assembly configured to move said first hinge connector to said selected position.

19. The apparatus as set forth in claim 18, further comprising a limit switch operative to limit compression of said container under operation of said motorized assembly.

20. The apparatus as set forth in claim 18, wherein said motorized assembly is operative to release said first hinge connector from said selected position.

21. The apparatus as set forth in claim 20, further comprising a limit switch operative to limit a range of motion of said motorized assembly in relation to reducing compression on said container.

22. A beverage container compressing apparatus comprising:

a compression assembly configured to receive a beverage container therein and apply a compressive force to at least one external surface of said container, said external surface bounding a beverage containing space of said container, said compression assembly comprising frame members pivotally interconnected by hinge connectors such that said frame members define a central opening configured to receive said container, said central opening being expandable and contractible by operation of said hinge connectors independent of any change of a circumference of said central opening; and a hinge controller directly connected to a first hinge connector of said hinge connectors, said first hinge connector interconnecting a first frame member and a second frame member of said frame members, said hinge controller configured to move said first hinge connector to a selected position by exerting a force directly on said hinge connector so as to provide relative angular movement between said first and second frame members independent of any separate force applied to said first and second frame members, and wherein said moving of said first hinge connector to said selected position changes a relative angular orientation between said first frame member and said second frame member, thereby causing at least one of said first and second frame members to apply said compression force to compress said container.

23. The apparatus as set forth in claim 22, wherein each of said frame members includes a bend, said bend being oriented such that said frame member is concave inwardly towards said central opening.

24. The apparatus as set forth in claim 23, wherein each said bend of each said frame member is disposed adjacent to a respective hinge connector of said hinge connectors, wherein an angle between the frame members interconnected by said respective hinge connector decreases when said central opening contracts.

25. The apparatus as set forth in claim 22, wherein said hinge controller comprises a manually operated mechanism configured to move said first hinge connector to said selected position.

26. The apparatus as set forth in claim 25, wherein said manually operated mechanism comprises a turn screw configured to move said first hinge connector.

27. The apparatus as set forth in claim 22, wherein said hinge controller comprises a motorized assembly configured to move said first hinge connector to said selected position.

28. The apparatus as set forth in claim 27, further comprising a limit switch operative to limit compression of said container under operation of said motorized assembly.

29. The apparatus as set forth in claim 27, wherein said motorized assembly is operative to release said first hinge connector from said selected position.

30. The apparatus as set forth in claim 29, further comprising a limit switch operative to limit a range of motion of said motorized assembly in relation to reducing compression on said container.

31. The apparatus as set forth in claim 22, wherein said hinge controller comprises a linkage between a source of a first force for compressing said container, and a predetermined location for applying a second force, responsive to said first force, to said first hinge connector, said linkage providing a mechanical advantage such that said second force is greater than said first force.

32. The apparatus as set forth in claim 22, wherein said hinge controller is operative to resist expansion forces so as to maintain said first hinge connector at any position of a continuous range of positions.

33. The apparatus as set forth in claim 22, wherein said hinge controller includes a translation element configured to translate between a vertical displacement of an actuator and an angular reposition of said first hinge connector.

34. The apparatus as set forth in claim 1, wherein said hinge controller is further configured to maintain said first hinge connector in each of said first selected position and said second selected position, where said container is in compression in both said selected positions and said hinge controller resists expansion forces associated with said compression.

35. The apparatus as set forth in claim 34, wherein said hinge controller is configured to maintain said first hinge connector in said first selected position after said hinge controller releases said first hinge connector from said second selected position and said expansion forces move said hinge connector from said second position to said first position.

36. The apparatus as set forth in claim 22, wherein said hinge controller is further configured to maintain said first hinge connector in each of a first selected position and a second selected position, where said container is in compression in both said selected positions and said hinge controller resists expansion forces associated with said compression.

37. The apparatus as set forth in claim 36, wherein said hinge controller is configured to maintain said first hinge connector in said first selected position after said hinge controller releases said first hinge connector from said second selected position and said expansion forces move said hinge connector from said second position to said first position.

* * * * *